United States Patent [19]

Reenstra

[11] Patent Number: 4,599,847

[45] Date of Patent: Jul. 15, 1986

[54] THERMAL CUT-OFF DEVICE FOR PACKAGING MACHINE

[76] Inventor: Arthur L. Reenstra, 105 Old York Rd., New Hope, Pa. 18938

[21] Appl. No.: 696,807

[22] Filed: Jan. 31, 1985

[51] Int. Cl.[4] ..... B65B 67/08

[52] U.S. Cl. ..... 53/390; 53/219; 219/221; 219/243

[58] Field of Search ..... 53/219, 390; 83/16, 83/171; 219/221 X, 242, 243 X

[56] References Cited

U.S. PATENT DOCUMENTS

| | | | |
|---|---|---|---|
| 2,395,241 | 2/1946 | Allen | 219/242 |
| 2,769,387 | 11/1956 | Penick | 219/242 |
| 3,724,167 | 4/1973 | Pizmont | 53/390 |
| 3,800,499 | 4/1974 | Feldman | 53/390 |
| 4,017,713 | 4/1977 | Lodi | 219/243 |

*Primary Examiner*—John Sipos
*Assistant Examiner*—Donald R. Studebaker
*Attorney, Agent, or Firm*—Paul and Paul

[57] ABSTRACT

In wrapping machinery for wrapping articles in heat sealable plastic film, a web of film is drawn from a supply roll and is severed by pulling the film under tension downwardly onto the narrow edge of a thermal cut-off device, which may be a heated rod or blade, to melt the film material along a thin transverse line and to permit severance thereof by pulling. Following severance of the film, the film-wrapped package is sealed by placing the package on a pedestal hot plate. The temperature of the hot plate is higher than that of the thermal cut-off device used to sever the film. The hot plate is supplied by electrical energy from a single source through a temperature sensor and control. The thermal cut-off device obtains its heat by conduction from the hot plate.

10 Claims, 5 Drawing Figures

THERMAL CUT-OFF DEVICE FOR PACKAGING MACHINE

BACKGROUND OF THE INVENTION

The present invention relates to wrapping machinery for wrapping, or for assisting an attendant to wrap, articles in heat sealable polyvinylchloride (PVC), or other plastic film. Such wrapping machinery is used primarily in supermarkets to wrap food products such as meats, vegetables, fruits, and the like prior to placing such items in the display counters. Usually the food products are placed in a plastic or cardboard tray before being wrapped in the plastic film.

In wrapping apparatus of the type being discussed, a web of continuous plastic film is drawn by an attendant from a supply roll mounted on the wrapper machine or console and the film is wrapped by the attendant in tubular fashion around the food product including the tray, if a tray is used. The attendant then severs the film from the supply roll by using a thermal cut-off device. After completing the wrapping, the package is placed on a pedestal hot plate to seal the film and the package.

In former wrapping mechanisms, the thermal cut-off device was a hot wire of small diameter, for example No. 23 gauge Nicrome wire having a diameter of 0.0226 inch. Because of the small cross-sectional area of such a hot wire, the quantity of heat stored therein was small, and the temperature dropped rapidly upon contact with the film. As a consequence, unless the initial temperature was very high, insufficient heat was available to sever the film. It was found, for example, that it was necessary to operate the small hot wire at a temperature of the order of 700° F. in order to effect satisfactory severence of the film. While this high temperature was sufficient to completely sever the film, it had the undesirable effect of overheating the film and causing smoke to be generated and emitted into the room in which the wrapping was being performed.

To overcome the generation of smoke, the prior art went to the use of a tubular rod of sufficient diameter and cross-sectional area to provide sufficient mass to store a guantity of heat so that the heated tubular rod was able to function as a reservoir of heat to replace that lost at the film contact line. In lieu of a tubular rod of sufficient cross-sectional area, the prior art also, for the same reason, used a rectangular blade of sufficient mass to store a quantity of heat. The prior art found that if the tubular rod or rectangular blade had sufficient mass to store a sufficient quantity of heat, the film could be separated and severed at the relatively low temperature of 325°-350° F. This temperature was low enough to avoid generation of objectionable smoke, and because the tubular rod or blade had sufficient mass to function as a reservoir or supply of instant heat, the line of contact with the film was maintained at a substantially constant and adequate temperature throughout the cutting period. The quantity of heat supplied and available was, however, not sufficient to completely sever the film but was sufficient to soften and score the film along the contact line to permit severence by having the attendant pull the film under tension. This technique has been used for some time and has been found to be satisfactory.

In the prior art wrapping machinery, using the technique just described, the food product and tray, after being wrapped in the plastic film, is placed by the attendant on a pedestal hot plate to heat seal the wrapped film and the package. The temperature used at the hot plate is higher than that of the thermal cut-off device which is used to soften and score the film to permit severence of the film by pulling. Since two different temperatures are involved, it has been customary in the prior art to use separate sources for supplying electrical energy to the hot plate on the one hand and to the thermal cut-off device on the other. Specifically, a first heat source, a first control sensor, and a first control circuit are used to supply heat to the hot plate, and a separate second heat source, a second control sensor, and a second control circuit are used to supply heat to the thermal cut-off.

SUMMARY OF THE PRESENT INVENTION

A principal object of the present invention is to provide a wrapping mechanism of the type last described above without providing two separate sources of electrical energy, one for the hot plate and a second for the thermal cut-off device.

The foregoing object is achieved, in accordance with the present invention by providing a single source of electrical energy to provide heat to the hot plate and by thermally coupling the hot plate to the thermal cut-off device, thereby using the hot plate itself as the source of heat for the thermal cut-off device.

DETAILED DESCRIPTION OF THE PREFERRED EMBODIMENTS

Figure 1:
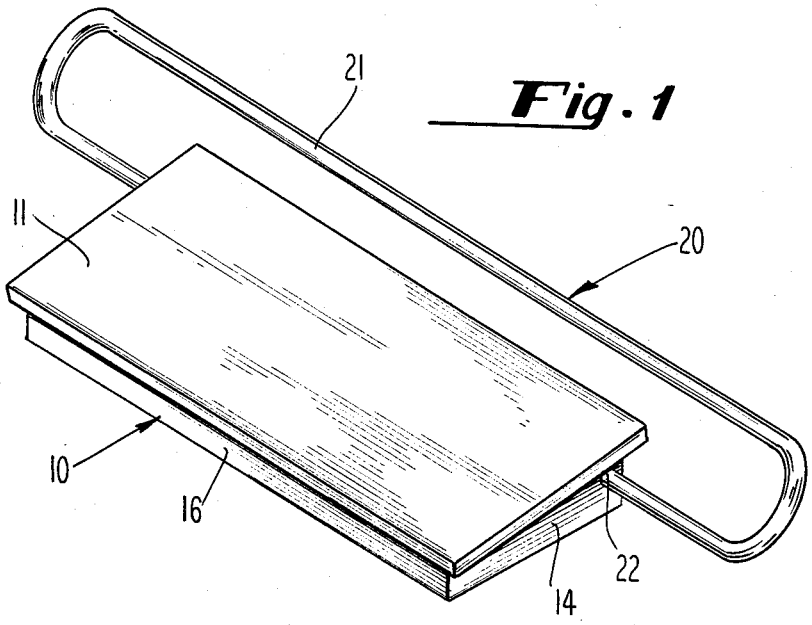
FIG. 1 is a perspective view of a mechanism according to the present invention showing the pedestal hot plate and showing connected thereto a copper rod which is used as the thermal cut-off device.

In FIG. 1, the hot plate unit 10 may comprise a heat-conductive metal plate or hot plate 11 supported on four side plates 14–17. Hot plate 11 may preferably be an aluminum plate having a thickness, for example, of 3/16 inch. Embedded in hot plate 11 is a tubular metal rod 12 having a resistance coil wound inside, known as a Calrod. Calrod 12 is supplied with current from a suitable electrical source, identified + and − in FIG. 2. The current supplied to Calrod 12 is sufficient to heat the hot plate 11 to a temperature of the order of 315°-325° F. Depending from hot plate 11 are four heat-conductive metal plates, two side plates 14 and 15, a front plate 16, and a rear plate 17. Plates 14–17 may preferably be aluminum.

In accordance with the present invention, a C-shaped or open-loop heat-conductive solid rod 20, preferably copper, is provided as a thermal cut-off device. Rod 20 has a continuous straight length portion 21. Opposite ends 22, 23 of the open-loop rod 20 are connected, as by welding, to side plates 14, 15.

It will be understood that when the aluminum hot plate 11 is heated by current flowing through the Calrod 12, heat from plate 11 is conducted to side plates 14, 15 and also to front and rear plates 16, 17, and these plates also become heated but to a lesser temperature than hot plate 11. Heat from the aluminum side plates 14, 15 is conducted into the solid copper rod 20 and, as a result, the straight continuous leg 21 acquires a temperature which is less than the temperature of hot plate 11. For example, if hot plate 11 is heated to a temperature of 315°–325° F., the straight leg 21 of the copper rod 20 may acquire a temperature of the order of 275°–285° F.

The temperature of copper rod thermal cut-off 20 relative to that of hot plate 11 is controlled by the locations at which the ends 22, 23 of the copper rod 20 are connected to the side plates 14, 15 of the hot plate unit 10. The greater the distance through the heat-conductive side walls 14–17 from the hot plate 11 to the solid rod connections at 22, 23, the lower the temperature of the straight leg portion 21 will be relative to the temperature of the hot plate 11.

Figure 3:
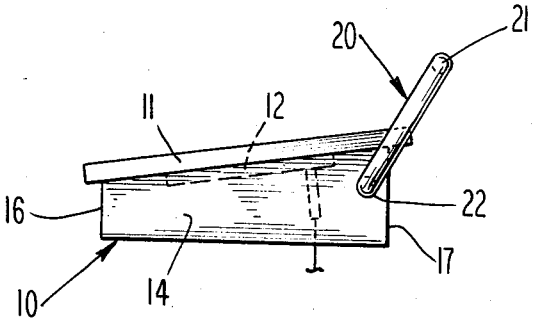
FIG. 3 is an end elevational view of the mechanism of FIG. 1.
Figure 4:
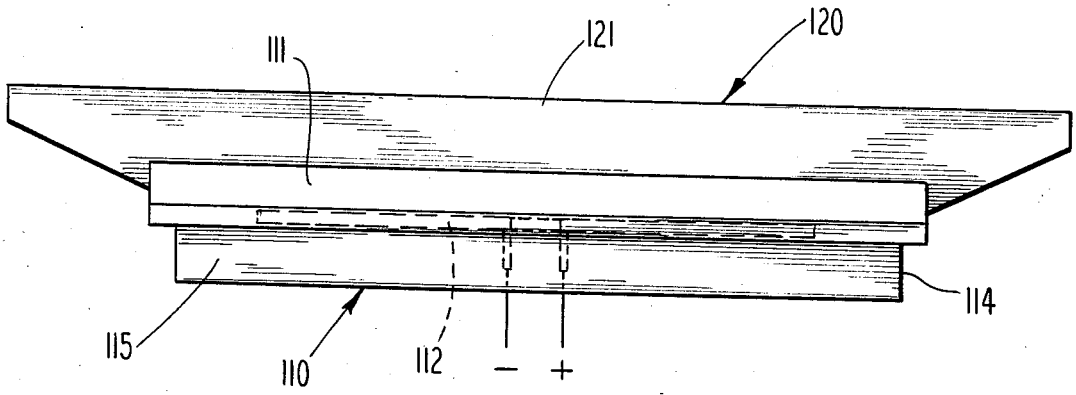
FIG. 4 is a front elevational view of an alternate embodiment in which the copper rod of FIG. 1 is replaced by a copper plate or blade.
Figure 5:
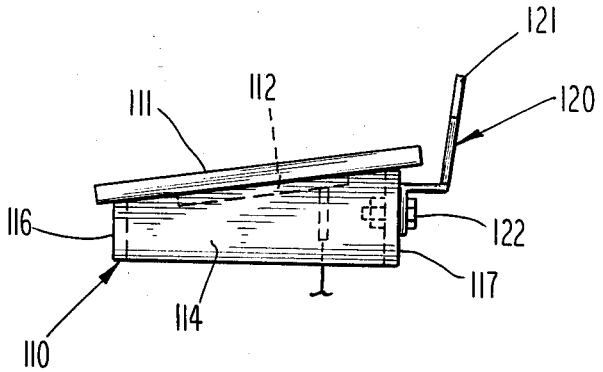
FIG. 5 is an end elevational view of the mechanism of FIG. 4.

FIGS. 4 and 5 illustrate an alternate embodiment in which the solid copper rod thermal cut-off 20 is replaced by a copper plate or blade 120. As seen in FIG. 5, the opposite ends of the copper plate 120 are connected, as by bolts 122, to rear wall 117 of the hot plate unit 110. In the embodiment of FIGS. 4 and 5, as in the case of the embodiment of FIGS. 1–3, the relative temperature of edge 121 of copper plate 120 relative to that of hot plate 111 is determined by the location of the connection of the ends of the copper plate 120 to the rear wall 117. The greater the distance through the heat-conductive material of the walls 14–17 from the hot plate 111 to the end connections 122, the lower the temperature of edge 121 of copper plate 120 will be relative to the temperature of hot plate 111.

For an example of one form of wrapping apparatus of the type to which the present invention is directed, see U.S. Pat. No. 3,367,589 issued to Chant Jr., et al in February 1968. See also U.S. Pat. No. 3,754,489 which issued to Carver Jr., et al in August, 1973. As seen in those patents, the thermal cut-off device, whether it be a hot rod or the edge of the hot blade, is only several inches (2" to 3") from the hot plate and as the attendant lowers the wrapped package toward the hot plate, the thermal cut-off device comes into contact with the film.

As described in Carver Jr., et al U.S. Pat. No. 3,754,489, the thermal cut-off device only needs to heat the film along the line to a temperature high enough to soften the film. The film is then stressed by the attendant by pulling it, and the film becomes severed along the softened line.

Figure 2:
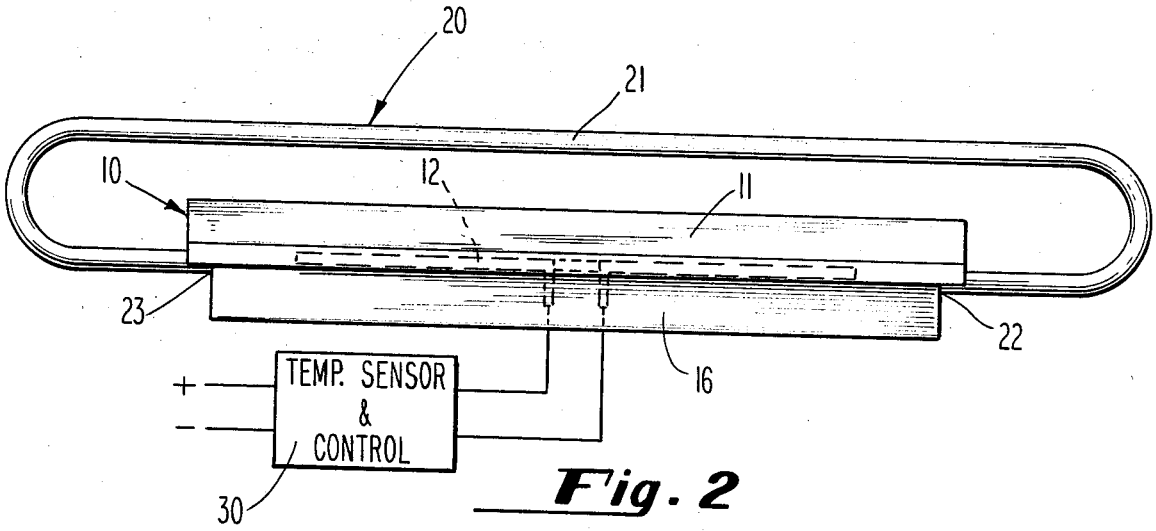
FIG. 2 is a front elevational view of the mechanism of FIG. 1.

By combining the hot plate and thermal cut-off device and controlling both by a single temperature sensor and control, illustrated as block 30 in FIG. 2, the costs and complexity of the wrapping machine is reduced and the reliability and safety is increased.

In the preferred embodiments, described above, the thermal coupling between the hot plate and the thermal cut-off device are the side walls of the pedestal-type hot-plate unit. It is to be understood, however, that other thermal coupling means may be provided between the hot plate itself and the thermal cut-off device. The temperatures difference between the hot plate and the thermal cut-off device is determined by the design of the thermal conduction or thermal resistance between the hot plate and thermal cut-off device.

I claim:

1. In wrapping machinery having a supply of heat-sealable plastic film for wrapping articles therein to form a sealed package:

a. a heat-conductor thermal cut-off conductor for severing the film from the film supply;

b. a hot-plate unit for sealing the package, said unit having a top hot plate;

c. a source of electric power for supplying electric current to said hot plate for heating the hot plate to a film-sealing non-burning temperature of the order of 300°–325° F.; and d. combination heat-conductive transfer means and thermal cut-off mounting means, coupling said hot plate in heat-conductive relation to said thermal cut-off conductor solely by said combination means to a film-softening non-burning temperature which is lower than said film-sealing temperature and which is of the order of 260°–285° F., and mounting said thermal cut-off to be carried directly by said hot-plate unit, whereby the heat transfer between the hot plate and the thermal cut-off takes place in a direct conductive path through the mounting means.

2. Apparatus according to claim 1 wherein said thermal cut-off conductor is a copper rod.

3. Apparatus according to claim 1 wherein said thermal cut-off conductor is a copper blade.

4. Apparatus according to claim 1 wherein said combination heat-conductive transfer and thermal cut-off mounting means is an aluminum plate connecting said hot plate to said thermal cut-off conductor.

5. Apparatus according to claim 2 wherein said combination heat-conductive transfer and thermal cut-off mounting means is an aluminum plate connecting said hot plate to said copper blade.

6. Apparatus according to claim 3 wherein said combination heat-conductive transfer and thermal cut-off mounting means is an aluminum plate connecting said hot plate to said copper blade.

7. Apparatus according to claim 4 wherein said aluminum plate is the rear plate of the hot-plate unit.

8. Apparatus according to claim 5 wherein the aluminum plate is the rear plate of the hot-plate unit.

9. Apparatus according to claim 6 wherein the aluminum plate is the rear plate of the hot-plate unit.

10. The apparatus of claim 1, wherein said source of electric power includes a temperature sensor and temperature control.

* * * * *

UNITED STATES PATENT OFFICE

CERTIFICATE OF CORRECTION

Patent No. 4,599,847 Dated July 15, 1986

Inventor(s) Arthur L. Reenstra

It is certified that error appears in the above-identified patent and that said Letters Patent are hereby corrected as shown below:

On first page, after designation of Inventor, please add assignee designation:

--[73] Assignee: Franklin Electric Subsidiaries, Inc., Fallsington, PA--

Column 1, line 43:

"quantity" should be --quantity--.

Signed and Sealed this

Fourth Day of November, 1986

[SEAL]

*Attest:*

DONALD J. QUIGG

*Attesting Officer*

*Commissioner of Patents and Trademarks*